United States Patent [19]

Layland et al.

[11] Patent Number: 4,883,516

[45] Date of Patent: Nov. 28, 1989

[54] AIR SEPARATION

[75] Inventors: David J. Layland, Norton; John T. Lavin, Chingford, both of England

[73] Assignee: The BOC Group, Inc., Murray Hill, N.J.

[21] Appl. No.: 176,900

[22] Filed: Apr. 4, 1988

[30] Foreign Application Priority Data

Apr. 7, 1987 [GB] United Kingdom ..... 8708266
Mar. 18, 1988 [GB] United Kingdom ..... 8806477

[51] Int. Cl.[4] ..... F25J 3/04

[52] U.S. Cl. ..... 62/22; 55/66; 62/24; 62/40

[58] Field of Search ..... 62/24, 22, 23, 11, 32, 62/36, 40, 42, 44; 55/66

[56] References Cited

U.S. PATENT DOCUMENTS

| | | | |
|---|---|---|---|
| 1,880,981 | 10/1932 | Pollitzer et al. | 62/31 |
| 3,729,943 | 5/1973 | Petit | 62/22 |
| 4,088,464 | 5/1978 | Biei | 62/22 |
| 4,433,989 | 2/1984 | Erickson | 62/22 |
| 4,507,134 | 3/1985 | Tomisaka | 62/30 |
| 4,568,528 | 2/1986 | Cheung | 62/22 |
| 4,604,116 | 8/1986 | Erickson | 62/22 |
| 4,662,917 | 5/1987 | Cormier, Sr. et al. | 62/13 |
| 4,662,918 | 5/1987 | Agrawal et al. | 62/13 |
| 4,705,548 | 11/1987 | Agrawal et al. | 62/22 |

FOREIGN PATENT DOCUMENTS

| | | |
|---|---|---|
| 1199293 | 8/1965 | Fed. Rep. of Germany . |
| 2305700 | 3/1976 | France . |
| 1258568 | 12/1971 | United Kingdom . |

*Primary Examiner*—Ronald C. Capossela
*Attorney, Agent, or Firm*—Carol A. Nemetz; R. Hain Swope; Larry R. Cassett

[57] ABSTRACT

An improved process and apparatus for separating air to form oxygen and nitrogen in at least one cryogenic distillation column is disclosed. Nitrogen vapor taken from the column is warmed in countercurrent flow to incoming air in a heat exchanger wherein compressed air is being cooled for separation. A portion of the warm nitrogen is compressed, cooled in the heat exchanger and passed through an expansion turbine. The expanded nitrogen is passed through a reboiler associated with the column and further cooled in the heat exchange means. Part of the resulting liquid nitrogen is used to provide reflux for the column and the remainder is taken as product. Preferably, at least a portion of the compressed air stream is expanded in a turbine, passed through the reboiler associated with the column to provide reboil therefor, liquified by heat exchange and introduced to the distillation column through a throttling valve. Further, an argon product can be recovered by withdrawing an argon-rich stream from a distillation column and passing it to a further column for purification. Vapor from the distillation column, or another in a plurality of distillation columns, is used to provide reflux for the further column with the resulting condensed vapor being returned to the column from which it was withdrawn.

11 Claims, 3 Drawing Sheets

AIR SEPARATION

This invention relates to a process and plant for air separation.

BACKGROUND OF THE INVENTION

It is well known to separate air into oxygen and nitrogen products by cryogenic distillation. It is conventional to liquify some or all of the nitrogen product taken from the distillation means. The liquefier may be independent of or integrated into the air separation plant. A liquid oxygen product may likewise be produced.

The present invention relates to an integrated air separation-nitrogen liquefaction process and plant. Such a process and plant is disclosed in UK patent specification No. 1 258 568. The disclosed process utilizes a single distillation column to separate incoming air into oxygen and nitrogen Reboil for the bottom of the distillation column is provided by a high pressure nitrogen stream which, after condensation in the reboiler, is sub-cooled and used partly to provide reflux for the distillation column and also to provide liquid nitrogen product. Refrigeration for the plant is by removing portions of the high pressure nitrogen upstream of the reboiler and expanding each such portion in a turbine. It has been found that this arrangement is relatively inefficient thermodynamically. A further inefficiency lies in the fact that the process includes a second distillation column to separate a crude argon stream from an argon enriched oxygen stream withdrawn from the first distillation column. This second distillation column is inefficient partly because there is no reboiler provided at the bottom thereof In contrast thereto, the present invention provides a process and apparatus utilizing an improved cycle for effecting reboil of a distillation column employed to separate air into oxygen and nitrogen which provides reflux for the distillation column and refrigeration for the liquefaction of the nitrogen. The present invention further provides improvement in the operation of an argon column associated with a distillation column or columns for separating air into oxygen and nitrogen.

SUMMARY OF THE INVENTION

In accordance with the present invention, there is provided a process of separating air comprising removing carbon dioxide and water vapor from compressed air, reducing the temperature thereof in heat exchange means to a temperature suitable for its separation into oxygen and nitrogen by cryogenic distillation, separating the air in at least one distillation column, warming nitrogen vapor taken from the distillation column countercurrently to the air in the heat exchange means, compressing some of the warmed nitrogen, cooling the compressed nitrogen in the heat exchange means, subjecting at least a portion of the cooled nitrogen to expansion in a turbine, passing the expanded nitrogen through a reboiler associated with the distillation column to provide reboil therefor, subjecting nitrogen leaving the reboiler to further cooling in the heat exchange means to liquify it employing a part of the resulting liquid nitrogen as reflux in the distillation column and taking the remaining liquid nitrogen as product.

Preferably, the subject process additionally includes the steps of expanding in a turbine at least a portion of the stream of compressed air which has been cooled by heat exchange, cooling the expanded stream by heat exchange to form a sub-cooled liquid which is introduced into the distillation column through a throttling valve. Air introduced into the column in this manner preferably comprises from about 5 to 10 percent of the total air introduced for separation.

The invention further provides apparatus comprising at least one compressor for compressing the air, means for removing carbon dioxide and water vapor therefrom, heat exchange means for cooling the air to a temperature suitable for cryogenic distillation, at least one distillation column for separating air into oxygen and nitrogen having an outlet to withdraw nitrogen vapor therefrom, said outlet being in fluid communication with the inlet of at least one nitrogen compressor via said heat exchange means, at least one expansion turbine having an inlet communicating with the outlet of said nitrogen compressor via said heat exchange means, and an outlet in fluid communication with an inlet to a reboiler associated with the distillation column, the reboiler having an outlet in fluid communication via said heat exchange means with means for providing liquid nitrogen reflux for the distillation column and an outlet for withdrawal of product liquid nitrogen.

DETAILED DESCRIPTION OF THE PREFERRED EMBODIMENTS

This invention will be described with reference to the drawings. Typical flow rates are given in parenthesis where applicable. Flow rates are $sm^3/hr$ wherein 1 $sm^3/hr$ is equal to 1 $m^3/hr$ at 15° C. and 1 atmosphere absolute.

Figure 1:
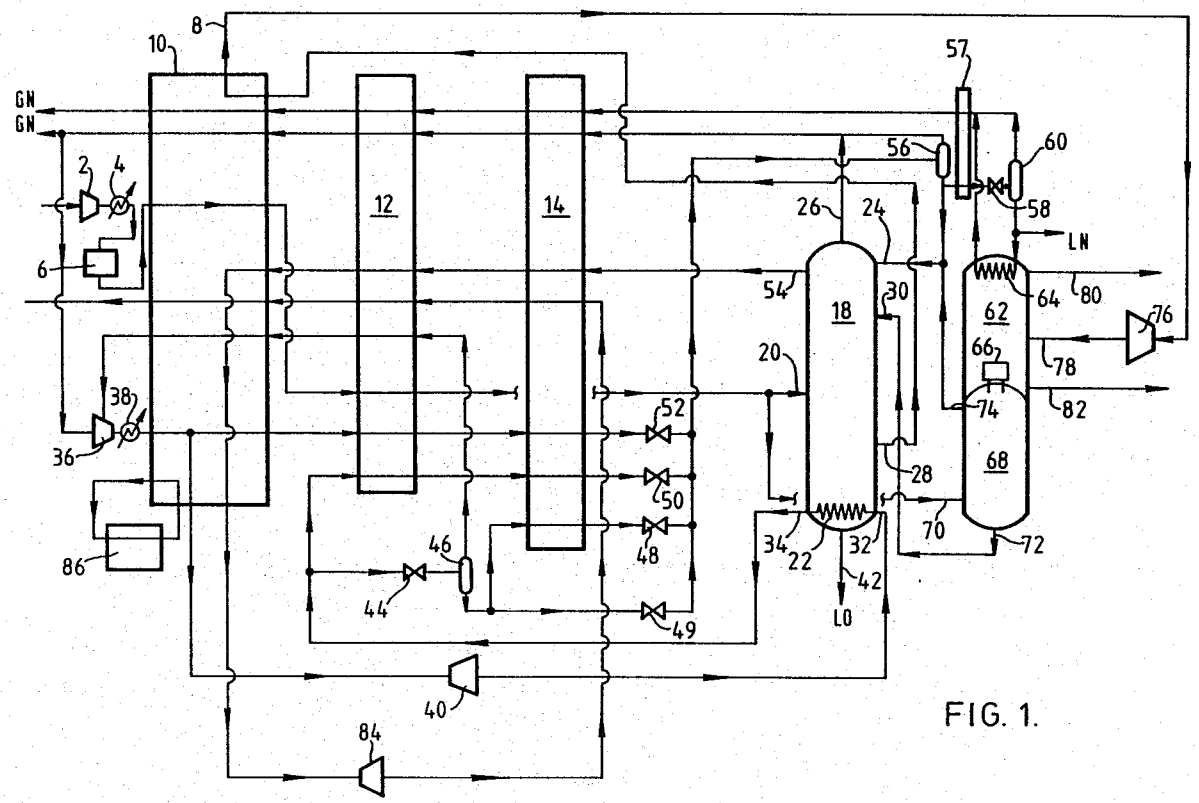
FIG. 1 is a schematic diagram of apparatus for carrying out the process of the subject invention.

Referring to FIG. 1, air flows (122 854 $sm^3/hr$) into a compressor 2, is compressed to a pressure of 6.2 atmospheres absolute and is cooled in a water after-cooler 4. Water vapor and carbon dioxide are removed from the air in a purification unit 6, typically containing molecular sieve absorbers. The compressed air then enters heat exchange means 8 comprising heat exchangers 10, 12 and 14 which may be discrete or fabricated as a single heat exchange block. The air enters the heat exchanger 10 at approximately ambient temperature and leaves it at a temperature on the order of 113 K., at which temperature it enters the heat exchanger 12. The air leaves the heat exchanger 12 at its dew point and is then divided into two parts. The major portion of the air flows (100,000 $sm^3/hr$) into a single distillation column 18 through an inlet 20. The column 18 typically operates at a pressure of about 6 atmospheres absolute and is adapted to separate the air into oxygen and nitrogen fractions. While the Process is described with reference to one distillation column, two or more can be utilized. It is preferred that the column for which reflux is provided also has a reboiler associated therewith as will be described hereafter.

The distillation column 18 is provided with a reboiler 22 at its bottom to form oxygen vapor and an inlet 24 at its top for liquid nitrogen reflux. The reboiler 22 boils liquid oxygen collecting at the bottom of the column 18 and causes vapor to ascend the column, while the inlet 24 for liquid nitrogen is able to provide a downward flow of liquid nitrogen reflux. Nitrogen vapor is withdrawn from the column 18 from an outlet 26 and passed through the heat exchangers 14, 12 and 10 in sequence. A minor proportion (13851 $sm^3/hr$) is withdrawn as product while the major Proportion (178 310 $sm^3/hr$) enters a multi-stage compressor 36 which raises the pressure of the nitrogen from 5.6 atmospheres absolute typically to 59 atmospheres absolute. In addition to the gaseous nitrogen withdrawn as product, it is also preferred to withdraw an oxygen product from the distillation column, typically in the liquid state, through outlet 42.

The nitrogen withdrawn from the distillation column is typically compressed in a multi-stage compressor to a pressure in excess of its critical pressure. The compressed nitrogen is preferably taken for expansion with the performance of external work at a pressure in the range 50 to 75 atmospheres and at a temperature preferably in the range 150 to 170 K. It is not essential to take all the compressed nitrogen for expansion with the performance of external work. If desired, some of the compressed nitrogen may be liquefied without passing through work-expansion means, i.e. a turbine, and the reboiler associated with the distillation column The nitrogen compressed in compressor 36 is cooled in a water cooler 38 and is passed into the heat exchanger 10 and flows therethrough co-currently with the incoming air. The compressed nitrogen is withdrawn (148 758 $sm^3/hr$) from the heat exchanger 10 at a temperature of 159 K. and passed into an expansion turbine 40 in which it is expanded to a pressure of 17.7 atmospheres (to give a reboiler delta T of 1.3 K.) with the performance of external work.

At the completion of work expansion, the nitrogen Preferably has a pressure from about 12 to 20 atmospheres absolute and is preferably a saturated vapor. Liquefaction of the nitrogen is then preferably effected in the reboiler 22. The work expansion is typically conducted in a single turbine which, if desired, may be employed to drive a compressor employed in the compression of the nitrogen or the air.

The nitrogen leaving the expansion turbine 40 as saturated vapor at a temperature of 113.6 K. is introduced into reboiler 22 through inlet 32. It passes through the reboiler 22 and thus provides the necessary heating to effect reboiling of liquid oxygen in the bottom of the column 18 while being itself condensed so that it leaves outlet 34 as a saturated liquid. This liquid is then divided into two parts. A major stream of liquid is taken therefrom (115 630 $sm^3/hr$), is flashed through throttling valve 44 into a phase separator 46 operating at a pressure of 8.2 atmospheres. The flash gas from the separator 46 passes through the heat exchangers 12 and 10 countercurrently to the incoming air (23 499 $sm^3/hr$) and is returned to a suitable stage of the compressor 36. The flash gas streams thereby provide refrigeration for the heat exchange means 8. A major portion of the liquid which flows (92 031 $sm^3/hr$) out of the phase separator 46 passes through the heat exchanger 14 from its warm end to its cold end (exit rate 70 734 $sm^3/hr$). It then flashes through a throttling valve 48. The remainder of the liquid flashes through a further throttling valve 49. Although two flash separation steps are adequate, it is preferred in the subject process to utilize three.

The remainder of the liquid nitrogen leaving the reboiler 22 enters (33 228 $sm^3/hr$) the warm end of the heat exchanger 12 and exits at a temperature of about 101 K. It then flows through the heat exchanger 14 from its warm end to its cold end leaving the cold end at a temperature of about 98 K. The liquid then flashes through a throttling valve 50 and the resulting 2-phase mixture is mixed with those issuing from the throttling valves 48 and 49. The resulting fluid stream is further combined with that part of the compressed nitrogen stream that does not flow through the expansion turbine 40. Such part of the compressed nitrogen stream exits the cold end of the heat exchanger 10 at a temperature of 113 K. and then flows through the heat exchangers 12 and 14 leaving the cold end of the latter at a temperature of about 98.5 K. (53 051 $sm^3/hr$) This fluid is then flashed through throttling valve 52 and is united with the fluid mixtures leaving the throttling valves 48, 49 and 50. The resulting fluid flows (178 310 $sm^3/hr$) into a phase separator 56 where it is separated into liquid and gas at a Pressure of 5.8 atmospheres. A first stream of liquid taken from the separator 56 (107 004 $sm^3/hr$) comprises the predominant part of the reflux stream introduced into the column 18 through the inlet 24. In addition, gas withdrawn from the separator 56 (6122 $sm^3/hr$) is combined with the nitrogen stream leaving the top of the distillation column 18 through the outlet 26.

It can thus be seen that there is a nitrogen circuit extending from the outlet 26 of the distillation column 18 through the compressor 36, the expansion turbine 40, the reboiler 22 and returning to the heat exchanger via the phase separator 56. The circuit is able provide most of the reflux, and all of the reboil for the distillation column 18 as well as providing a considerable amount of the refrigeration required for the heat exchangers 10, 12 and 14. Moreover, these results may be achieved at a relatively high thermodynamic efficiency in comparison with the comparable aspects of the apparatus described in the drawing accompanying UK patent specification No. 1 258 568.

Additional refrigeration for the heat exchange means 8 may be obtained by withdrawing a waste nitrogen vapor stream from the distillation column 18, increasing its temperature in said heat exchange means 8, subjecting it to expansion with the performance of external work, typically in an expansion turbine, and returning the gas through the heat exchange means 8. The waste nitrogen may then be vented to the atmosphere.

Net refrigeration for the heat exchange means 8 between ambient temperature and the temperature of the compressed nitrogen at the start of its work expansion may be provided by any conventional means. Typically, a further expansion turbine employing nitrogen as the working fluid may be used to provide net refrigeration in the lower part of this temperature range and a fluorocarbon refrigeration cycle used to provide net refrigeration for the remainder thereof.

A liquid nitrogen product is obtained from the separator 56 by taking a second stream of liquid nitrogen (65 184 $sm^3/hr$) therefrom and passing it through a subcooling heat exchanger 57, flashing it through throttling valve 58 into a phase separator 60 operating at a pressure of 2.7 atmospheres absolute. Flash gas is withdrawn from the phase separator 60 (5381 $sm^3/hr$) and passed through the heat exchanger 57 countercurrently to the second stream of liquid nitrogen withdrawn from the phase separator 56. A liquid nitrogen product stream is withdrawn from the phase separator 60 (25 748 $sm^3/hr$). Further liquid nitrogen is withdrawn from the phase separator 60 and is utilized in a manner to be described below.

According to a second aspect of the present invention, there is provided a process of separating air, comprising removing carbon dioxide and water vapor from compressed air, reducing the temperature of the compressed air in heat exchange means to a temperature suitable for separation by cryogenic distillation, separating the air into nitrogen and oxygen using one or a plurality of distillation columns, taking a stream enriched in argon from one of said columns and introducing it into a further distillation column in which an argon product is separated therefrom, and employing vapor from the single column or, if a plurality is utilized, another of the columns to provide reboil for the further distillation column, the resulting condensed vapor being returned as reflux to the column from which it was withdrawn. Typically, at least one stream of argon-enriched fluid is withdrawn from the said distillation column and subjected to separation in the further distillation column. The argon-enriched stream may be withdrawn as vapor or liquid. Alternatively, both liquid and vapor streams may be withdrawn.

The invention also provides apparatus for performing such process comprising at least one compressor for compressing air, means for removing carbon dioxide and water vapor therefrom, heat exchange means for cooling the air to a temperature suitable for separation by cryogenic distillation, one or a plurality of distillation columns for separating the air into nitrogen and oxygen, a further distillation column having an inlet for an argon-enriched stream in fluid communication with an outlet from one of said plurality of distillation columns, a condenser reboiler adapted to provide reboil for the said further distillation column and reflux for said distillation column or another of said plurality of distillation columns.

Preferably, oxygen-rich liquid is taken from the bottom of one of the distillation columns and introduced into the distillation column from which the argon-rich stream is withdrawn at a level intermediate that of the outlet therefor and the top of the column. Such use of the oxygen-rich liquid helps to enhance the efficiency of the distillation columns. In addition, employing a vapor from the top of another of the distillation columns to provide reboil for the further, or argon, distillation column helps to enhance the thermodynamic efficiency with which such column operates.

Preferably, the processes according to first and second aspects of the present invention are operated in conjunction. Further, it is preferred that at least some of the liquid nitrogen formed in accordance with the first aspect of the invention is employed to provide condensation of argon vapor and hence reflux for the further distillation column.

The argon product, which may be taken as a liquid or a vapor, typically contains up to about 2% by volume of oxygen and may be purified by conventional means to yield pure argon. The distillation column or plurality of columns preferably operate at similar pressures, while the further or argon distillation column operates at a lower pressure. Accordingly, it is desirable to withdraw the argon-enriched stream from a distillation column, reheat it in said heat exchange means and subject it to expansion, typically in an expansion turbine, with the performance of external work upstream of introducing it into the further distillation column. Alternatively, the argon-rich stream may be passed through an expansion valve into the further distillation column. In addition, it is desirable to transfer argon-enriched liquid from the distillation column to said further distillation column. Such transfer of liquid helps to increase the proportion of the total oxygen product produced by the further column and reduces the refrigeration required to operate the distillation columns. Typically, the argon-enriched liquid is passed through a throttling valve into the further distillation column, although it may, if desired, be sub-cooled upstream of its passage through the throttling valve.

Referring again to FIG. 1, it will be appreciated that, in addition to providing nitrogen product and heat exchange fluid, the distillation column 18 also provides liquid oxygen product which is withdrawn from the bottom of the column through an outlet 42 (18 470 $sm^3/hr$). Column 18 is also used to provide a stream of oxygen relatively rich in argon. This stream is taken from outlet 28 at a level a little below that at which the argon concentration in the column 18 is at a maximum. It is separated in a further distillation column 62 operating at a pressure of about 1.3 atmospheres. The column 62 is provided with a condenser 64 at its top and a condenser reboiler 66 at its bottom. The condenser-reboiler 66 provides reflux for a second distillation column 68 having an inlet 70 for a minor portion (22 854 $sm^3/hr$) of the compressed air withdrawn from the cold end of the heat exchanger 12. The column 68 operates at a similar pressure to the column 18 and provides for the column 18 a stream of oxygen-rich liquid which is withdrawn from the column 68 through the outlet 72 and enters the distillation column 18 through the inlet 30. This stream of oxygen-rich liquid increases the efficiency of the column 18 by reducing its overall demand for liquid nitrogen reflux through the inlet 24. More importantly, column 68 provides the necessary heat for reboiling liquid oxygen separated in the column 62. Column 68 also provides a stream of oxygen-poor liquid (9 996 $sm^3/hr$) which is withdrawn from an outlet 74 at an upper region thereof and is united with the first stream of liquid nitrogen withdrawn from the phase separator 56 to provide the liquid nitrogen reflux that is introduced into the column 18 through the inlet 24.

The feed for the column 62 is provided by withdrawing the argon-enriched oxygen stream from the column 18 through the outlet 28 (8350 $sm^3/hr$), introducing the stream into the heat exchanger 10 at its cold end, withdrawing it from an intermediate region of the heat exchanger 10 at a temperature of about 137 K. and passing it to an expansion turbine 76 in which it is expanded with the performance of external work to the operating pressure of the column 62. The expanded fluid is then introduced into the column 62 through an inlet 78.

Reflux for the column 62 is provided by withdrawing a second stream of liquid nitrogen from the phase separator 60 (33 562 $sm^3/hr$) and passing it through the condenser 64. The resultant vaporized nitrogen leaving the condenser 64 is united with the flash gas separator 60 upstream of the cold end of the heat exchanger 57. The combined gases flow from the warm end of the heat exchanger 57 through the heat exchangers 14, 12 and 10, in sequence, forming a product nitrogen stream (38 444 $sm^3/hr$ and 2.5 atmospheres). By employing both a condenser 64 and a reboiler 66, the operation of the argon column 62 may be made relatively efficient in comparison with that described in the aforementioned UK patent specification. Accordingly, a relatively high number of trays, for example on the order of 100, may be employed in the column 62.

A crude liquid argon product, typically containing on the order of 2% by volume of oxygen, is withdrawn from the top of the column 62 through an outlet 80 (1058 $sm^3/hr$) and a further liquid oxygen product stream is withdrawn from the bottom of the column 62 through an outlet 82 (7292 $sm^3/hr$).

The requirements for refrigeration of the above described process are not met wholly by the operation of the expansion turbine and associated circuits. Further refrigeration is provided by withdrawing a stream (17000 $sm^3/hr$) of waste nitrogen from a few trays below the top of the column 18 through the outlet 54, sequentially passing the stream through the heat exchangers 14, 12 and 10. The stream of waste nitrogen withdrawn from the heat exchanger 10 at a temperature of 140 K. is expanded to about atmospheric pressure in a further expansion turbine 84. The resulting expanded waste nitrogen stream is then introduced at a temperature of 96 K. into the cold end of the heat exchanger 14 and passed through heat exchangers 12 and 10. The waste stream may be vented or preferably used to regenerate molecular sieve absorbers employed to extract carbon dioxide and water vapor from the incoming air.

Refrigeration for the warm end of the heat exchanger 10 is provided by refrigeration unit or means 86. Such unit may comprise a mixed hydrocarbon refrigerant cascade cycle or a combination of a fluorocarbon refrigeration unit and a "warm" nitrogen expansion turbine cycle which turbine may typically have an inlet temperature 200 K. and an outlet temperature of about 160 K.

Many changes and modifications to the apparatus shown in FIG. 1 are possible without departing from the scope of the invention described herein. For example, reduction in pressure of the second liquid nitrogen stream withdrawn from the phase separator 56 may be accomplished in at least two successive flash separation stages rather than the single stage (comprising valve 58 and phase separator 60) as shown in FIG. 1. In addition, the liquid oxygen product withdrawn from the column 18 through the outlet 42 may be sub-cooled and subjected to a plurality of flash separation stages in order to provide a liquid oxygen product at nearer atmospheric pressure and a gaseous oxygen product which can be returned through the heat exchangers 14, 12 and 10, thereby providing additional refrigeration for the heat exchangers. Furthermore, it is not essential to use molecular sieve absorbers or other means 6 to remove the carbon dioxide and water vapor from the incoming air. Instead, the heat exchanger 10 may be a reversing heat exchanger. In this instance, however, the waste nitrogen stream withdrawn from the column 18 will typically be used as the stream for regenerating the heat exchanger 10 and, consequently, its flow rate will be substantially greater than described above. In addition, additional boost compressors (not shown) may be employed to provide further compression of the nitrogen leaving the compressor 36 or the air leaving the compressor 2. For example, three such booster-compressors may be employed, one driven by the turbine 40, another by the turbine 76, and a third by the turbine 84. A further boost-compressor may be associated with any turbine employed in the refrigeration means 86. Another improvement that can be made to the apparatus shown in FIG. 1, is to withdraw argon enriched liquid from the distillation column 18 and pass it through an expansion valve into the column 62, typically at a level below the inlet 78, to enhance the proportion of liquid oxygen produced by the column 62. It is alternatively or additionally possible to pass a liquid oxygen stream from the column 18 into the column 62.

There is considerable flexibility in the relative rates at which oxygen and nitrogen products can be produced by the apparatus shown in FIG. 1. In the above described example, all the oxygen product from the column 8 is produced as liquid. If desired, the flow of nitrogen through the reboiler 22 can be increased to produce a gaseous oxygen product that can be taken at a level below the lowermost tray (not shown) in the column 18.

Figure 2:
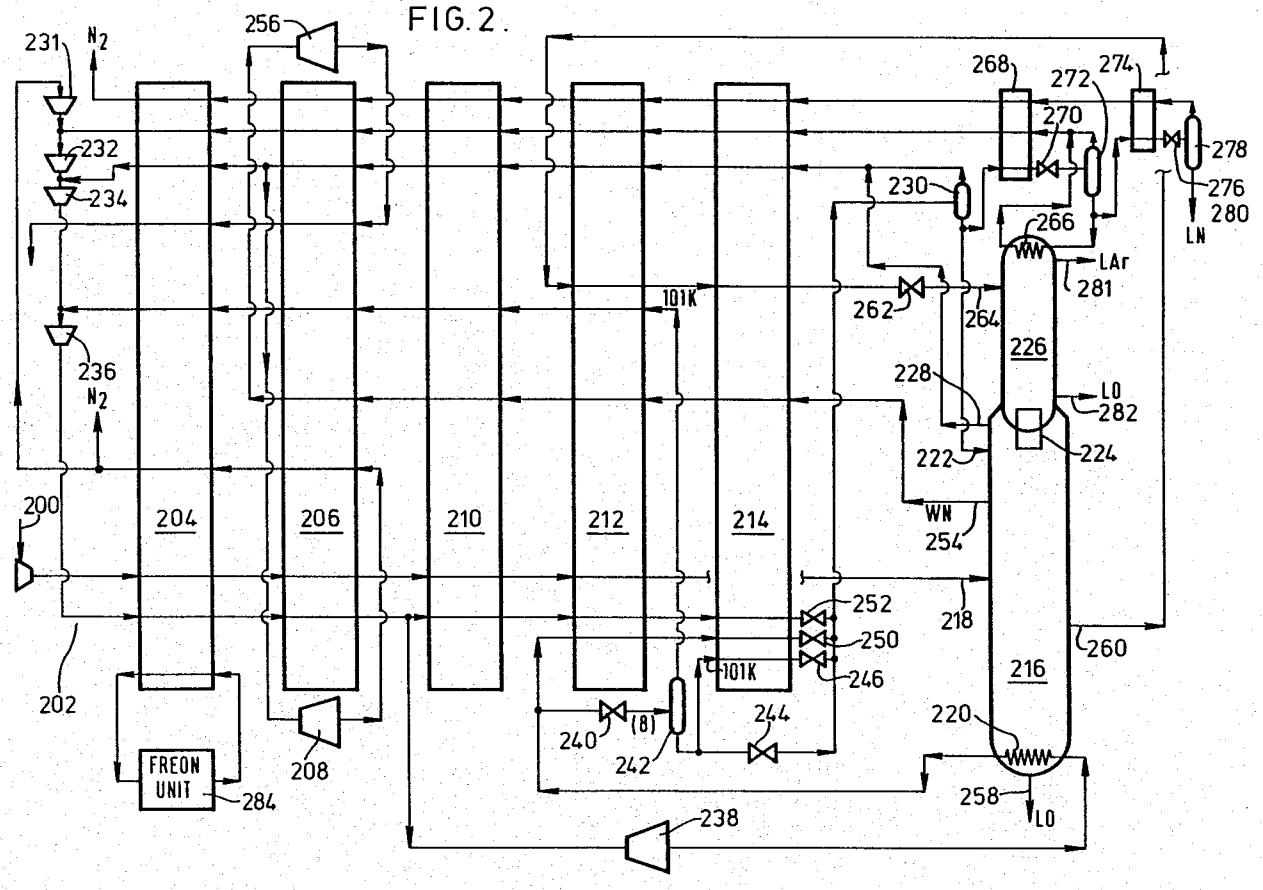
FIG. 2 is a schematic diagram of another apparatus for carrying out the process of the subject invention.

Referring to FIG. 2, air flows (130 000 $sm^3/hr$) into a compressor 200 and is compressed to a pressure of 6.2 atmospheres absolute. The air stream, which is at 208 K., flows through a series of heat exchangers, 204, 206, 10 and 212, leaving heat exchanger 204 at 235 K., leaving heat exchanger 206 at 159 K., leaving heat exchanger 210 at 113.6 K., and leaving heat exchanger 212 at 101 K. (its dew point). The air is then introduced into a first or main distillation column 216 at a pressure of 6 atmospheres absolute through an inlet 218.

The distillation column 216 is provided at its top with an inlet 222 for substantially pure liquid nitrogen reflux and at its bottom with a reboiler 220. In addition, there is a condenser-reboiler 224 which condenses vapor at the top of column 216 to provide additional reflux and provides reboil at the bottom of a second distillation column 226. Nitrogen that passes through a reboiler 220 and into the inlet 222 of the column 216 is provided in a nitrogen refrigeration and liquefaction cycle that starts and ends in the column 216. Thus, substantially pure nitrogen vapor is withdrawn from the top of the column 216 through an outlet 228 at approximately 206,747 $sm^3/hr$ and a temperature of 96 K. and is mixed with an additional 9,407 $sm^3/hr$ of nitrogen taken from a phase separator 230, to be described hereafter. The temperature of combined nitrogen stream is raised to 98 K. by passage through heat exchanger 214. It then flows through the heat exchangers 212, 210, and 206 in sequence countercurrently to the incoming air flow, leaving heat exchanger 206 at about 230 K. The stream is then divided into minor and major parts. The major part of this nitrogen stream (156 249 $sm^3/hr$) is expanded in expansion turbine 208 with the performance of external work. The expanded nitrogen stream leaves the turbine 208 at a temperature of 155 K. and a pressure of 1.1 atmospheres absolute. The expanded nitrogen stream is then warmed to about 298 K. by passage through heat exchangers 206 and 204. The expanded nitrogen stream is then divided to form a first subsidiary stream (51,575 $sm^3/hr$) which is taken as product, and a second subsidiary stream (104 674 $sm^3/hr$) which is compressed in a compressor 231. The nitrogen stream leaves the compressor 231 at a pressure of about 2.8 atmospheres absolute and is mixed with a further stream of nitrogen (whose formation will be described below). The combined stream is compressed in a further compressor 232.

The nitrogen stream leaving (151 137 $sm^3/hr$) the compressor 232 at a pressure of about 5½ atmospheres absolute is mixed with the minor part of the nitrogen stream (51,249 $sm^3/hr$) from the heat exchanger 206. The resulting mixed stream is compressed in a compressor 234 to a pressure of 8 atmospheres and is combined at a temperature of 298 K. with a yet further stream of nitrogen (26089 $sm^3/hr$). The resulting stream (237 131

$sm^3/hr$) is compressed in compressor 236 and passed through the heat exchangers 204 and 206 co-currently with the incoming air thereby being cooled to 159 K. The stream is then divided into a major part (174 640 $sm^3/hr$) which is passed to the inlet of an expansion turbine 238 and a minor part to be described below. The major nitrogen stream is expanded with the performance of external work in the turbine 238 at a pressure of 17.6 atmospheres and a temperature of 113.6 K. This fluid stream then passes through the reboiler 220 of the first distillation column 216 and thus Provides reboil therefor, the nitrogen itself being at least partially, and normally fully, condensed. The resulting nitrogen stream leaves the reboiler 220 and is divided into a major stream and a minor stream. The major stream is flashed (130 610 $sm^3/hr$) through a throttling valve 240 and is thereby reduced in pressure to 8 atmospheres. The resulting two-phase mixture is then separated in a phase separator 242.

A vapor stream is withdrawn from the separator 242, warmed to 298 K. by sequential passage heat exchangers 212, 210, 206 and 204 and used as the nitrogen which is mixed with the 8 atmosphere stream of nitrogen between the compressors 234 and 236. The liquid collected in the phase separator 242 is used to form a further two-phase stream which is passed to a further phase separator 230. Accordingly, a first stream of this liquid is flashed (86,434 $sm^3/hr$) through a throttling valve 244 and the resulting liquid-vapor mixture passed to the phase separator 230. Upstream of the phase separator 230, the liquid-vapor mixture is mixed with a further liquid-vapor stream which is formed by taking another stream of liquid nitrogen (18,087 $sm^3/hr$) from the bottom of the phase separator 242 at a temperature of 101 K., sub-cooling it to 98 K. by passage through heat exchanger 214, and flashing it through a throttling valve 246, thereby reducing its pressure to 5.8 atmospheres absolute.

Another component of the liquid-vapor mixture passing to the phase separator 230 is formed from the minor stream of liquid from the reboiler 220 which by-passes the valve 240 and flows (44,030 $sm^3/hr$) at a pressure of 17.6 atmospheres absolute through the heat exchanger 212, being thereby cooled to a temperature of 101 K. The resulting liquid is further cooled to 98 K. by passage through heat exchanger 214, flashed through a throttling valve 250 and united with the liquid-vapor mixture passing to the phase separator 230. A fourth component to the liquid-vapor mixture passing to the phase separator 230 is formed by the minor part of the nitrogen stream from the heat exchanger 206 that by-passes the expansion turbine 238. This part of the nitrogen stream flows (62,491 $sm^3/hr$) at a pressure of 59 atmospheres absolute from the warm end to the cold end of heat exchangers 210, 212 and 214 in sequence, leaving the warm end of the heat exchanger 214 at a temperature of 98 K., and is passed through a throttling valve 252 to reduce its pressure to 5.8 atmospheres. The resulting liquid-vapor mixture is mixed with the rest of the liquid-vapor mixture passing to the phase separator 230.

A first stream of liquid nitrogen is withdrawn (201 635 $sm^3/hr$) from the phase separator 230 and introduced into the top of the distillation column 216 through inlet 222 to serve as reflux. As will be described more fully below, a second stream of liquid nitrogen withdrawn from the phase separator 230 is used to form nitrogen product and to provide condensation of vapor at the top of the second distillation column 226 in which a liquid argon product is formed.

A stream of impure nitrogen, typically containing about 0.2% of oxygen is withdrawn (19,500 $sm^3/hr$) from the first distillation column 216 through an outlet 254. This stream sequentially flows through the heat exchangers 212, 210 and 206 countercurrently to the flow of incoming air and is thus cooled to a temperature of 230 K. The stream is then expanded with the performance of external work in an expansion turbine 256. The stream leaves the expansion turbine 256 at a pressure of 1.1 atmospheres absolute and a temperature of 155 K. It is warmed to 298 K. by passage through the heat exchangers 206 and 204 to form a waste stream which is vented to the atmosphere.

Liquid oxygen is also withdrawn (15,388 $sm^3/hr$) from the bottom of the first distillation column 216 through an outlet 258. The liquid oxygen is then preferably passed through a throttling valve (not shown) in the column 226, and is then taken from the column 226 as described below.

In addition to providing nitrogen and oxygen fractions, the distillation column 216 also provides an argon-enriched oxygen-vapor feed to the second distillation column 226. Accordingly, argon-enriched oxygen vapor, typically containing on the order of 9% by volume of argon, is withdrawn (13,050 $sm^3/hr$) through an outlet 260 from a level in the column 216 below that of the air inlet 218, is passed to the warm end of the heat exchanger 212 and is liquefied by passage therethrough. The resulting liquid argon-oxygen mixture at a temperature of 101 K. is then sub-cooled by passage through the heat exchanger 214. The sub-cooled argon-oxygen liquid mixture is passed through a throttling valve 262 and introduced into the second column 226 through an inlet 264 at a pressure of 1.3 atmospheres absolute. Reboil for the second distillation column 26 is provided by the condenser-reboiler 224 and reflux is provided by operation of a condenser 266 in the top of the column 226.

Cooling for the condenser 266 is provided by a stream of liquid nitrogen taken rom the phase separator 230 (76,950 $sm^3/hr$) and sub-cooled from 96 to 90 K. in a heat exchanger 268. The resulting sub-cooled nitrogen is flashed through a throttling valve 270 to form a liquid-vapor mixture which is passed to a phase separator 272 which operates at 3 atmospheres absolute. A first stream of liquid is withdrawn (41,389 $sm^3/hr$) from the phase separator 272 and is passed through the condenser 266, thus condensing vapor and hence providing reflux in the column 226 while being vaporized itself. The resulting vapor is mixed with vapor withdrawn from the top of the phase separator 272, and returned through the heat exchanger 268 countercurrently to the flow therethrough of liquid nitrogen from the phase separator 230. The nitrogen vapor is thus warmed to 94 K. It is subsequently warmed to 298 K. by sequential passage through the heat exchangers 214, 212, 210, 206 and 204 in sequence and forms the gas stream that is mixed with the one leaving the compressor 231.

A second stream of liquid nitrogen is withdrawn (30,486 $sm^3/hr$) from the phase separator 272 and is sub-cooled in heat exchange 274, to reduce its temperature from 90 to 88 K. The sub-cooled liquid nitrogen is then flashed through a throttling valve 276 to form a two-phase mixture which is collected in phase separator 278. Saturated liquid nitrogen product at a pressure of 1.3 atmospheres absolute is withdrawn (27,579 $sm^3/hr$) from the phase separator 278 through an outlet 280.

Nitrogen vapor is withdrawn from the top of the phase separator 278 at a rate of 2907 $sm^3/hr$ and is progressively warmed to 298 K. by sequential passage through heat exchangers 274, 268, 214, 212, 210 206 and 204. This gaseous nitrogen is also collected as product.

By providing reboil and reflux in the second distillation column, it is possible to separate a liquid oxygen product as well as a liquid argon product therein. A stream of liquid argon, typically containing up to 2% by volume of oxygen as an impurity, is withdrawn from the distillation column 226 (1,178 $sm^3/hr$) at a pressure of 1.2 atmospheres absolute through an outlet 281 positioned at or near the top of the column 226. Liquid oxygen product is withdrawn from the bottom of the column 226 through an outlet 282 (27,260 $sm^3/hr$) at a pressure of 1.4 atmospheres absolute. This liquid oxygen product comprises that formed by fractionation in the column 226 supplemented by the liquid oxygen withdrawn through the outlet 258 from the first distillation column 216 which is, if desired, sub-cooled, passed through a throttling valve (not shown) and introduced into the bottom of the column 226.

It will be appreciated that refrigeration for the heat exchanger 206 is provided by the expansion of the nitrogen stream in turbine 208 and the impure nitrogen stream in the expansion turbine 256, while net refrigeration for the heat exchanger 204 operating between 235 and 300 K. is met by a mechanical refrigeration machine 284 using fluorocarbons as a working fluid.

If desired, the heat exchangers 204, 206, and 210 may be made as one heat exchange block. It is additionally or alternatively desirable to form the heat exchangers 204 and 206 as a reversing heat exchanger such that the waste nitrogen stream from the turbine 256 can be used to sublime deposits of ice and solid carbon dioxide left on the heat exchange passages in such heat exchangers by the passage of air therethrough. The operation of reversing heat exchangers is well known in the art and will not be described further herein.

Typically, the compressors 231, 232, 234 and 236 may comprise separate stages of a single multi-stage rotary compressor. Each such compressor will have its own water cooler associated therewith to remove the heat of compression. In addition, the expansion turbines 208, 238 and 256 may each drive a booster compressor used in the compression of the incoming air or nitrogen.

Many modifications to the plant shown in FIG. 2 are possible without departing from the invention For example there may be several liquid-vapor contact trays in the column 216 disposed between the level of the outlet 228 and the condenser-reboiler 224, with there being an additional outlet for nitrogen provided above the uppermost of these trays. This enables a particularly pure nitrogen stream, typically containing less than lvpm of oxygen, to be withdrawn from the column 216.

In another modification the column 216 may be provided as two separate vessels, typically arranged one above the other, with the lower vessel passing vapor from its top to the bottom of the upper vessel and receiving liquid at its top from the bottom of the upper vessel. The upper vessel may be used as a nitrogen impurification vessel, the waste nitrogen stream being withdrawn through the outlet 254 from the lower vessel.

Figure 3:
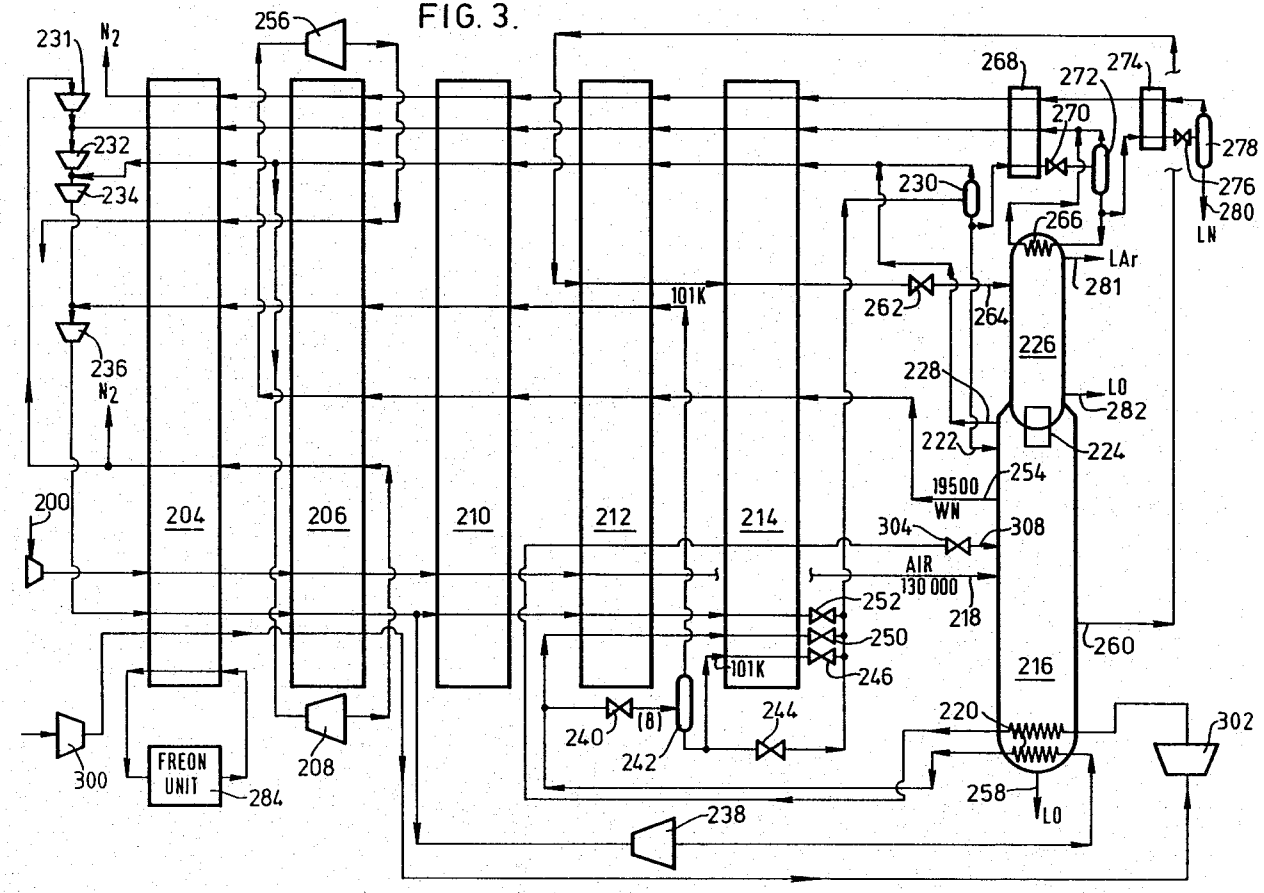
FIG. 3 is a schematic diagram of a further apparatus for carrying out the process of the subject invention.

A further modification to the plant shown in FIG. 2 is illustrated in FIG. 3. Like parts occurring in FIGS. 2 and 3 are indicated by the same reference numerals. Referring to FIG. 3, not all of the reboil requirements of the first distillation column 216 are met by the nitrogen flowing through the reboiler 220. Instead, there is an additional reboil cycle in which the working fluid is air. Accordingly, air is compressed in a compressor 300 to a pressure of 47 atmospheres absolute. After removal of its heat of compression by a water cooler (not shown) the compressed air is cooled to a temperature of 159 K. by passage through heat exchangers 204 and 206. The air stream is expanded in an expansion turbine 302 to a pressure of 15.6 atmospheres and a temperature of 113.6 K. The resultant expanded air then passes through the reboiler 220 and is condensed by passage therethrough. The condensed air then enters the warm end of the heat exchanger 212 at a temperature of 113.6 K. and flows through the heat exchangers 212 and 214 leaving the cold end of the heat exchanger 214 at a temperature of 98 K. The resulting sub-cooled liquid air is then flashed through a throttling valve 304 to form a liquid-vapor mixture which enters the column 216 at a pressure of 5.9 atmospheres absolute through an inlet 308 located a few trays above that of the inlet 218. Typically, the air flow through the turbine 302 is about 7% of the total gas flow through the reboiler 220, and about 8% of the total air introduced into the first distillation column 216. By introducing some of the air into the first distillation column 216 as liquid, the overall column and cycle efficiencies are improved.

I claim:

1. A process of separating air comprising removing carbon dioxide and water vapor from compressed air, reducing the temperature of the compressed air in a heat exchange means to a temperature suitable for its separation by cryogenic distillation, separating the air into nitrogen and oxygen using one or a plurality of distillation columns, taking a stream enriched in argon from one distillation column and introducing it into a further distillation column in which an argon product is produced, introducing vapor from said one column or another of said plurality of columns into said further distillation column to provide reboil therefor; and returning the resulting condensed vapor as reflux to the distillation column from which it was withdrawn.

2. A process in accordance with claim 1, wherein a plurality of columns is utilized and oxygen-rich liquid is taken from the bottom of said other distillation column and introduced into the distillation column from which the argon-rich stream is withdrawn at a level intermediate that of the outlet for withdrawal of said stream and the top of the column

3. A process in accordance with claim 1, wherein air is separated in one distillation column.

4. A process in accordance with claim 1, wherein nitrogen is withdrawn from said one distillation column, liquefied, and a portion of the resulting liquid nitrogen utilized to provide refrigeration and reflux for the further distillation column.

5. A process in accordance with claim 1, wherein the argon-enriched stream taken from said one distillation column is reheated in said heat exchange means and is then subjected to expansion in a turbine upstream of its introduction into the further distillation column.

6. A process in accordance with claim 1, wherein said argon-enriched stream is withdrawn as vapor, warmed in the heat exchange means and expanded in a turbine upstream of the introduction thereof into said further distillation column.

7. Apparatus for separating air, comprising at least one compressor for compressing air, means for removing carbon dioxide and water vapor from the air, heat exchange means for reducing the temperature of the air to a temperature suitable for its separation by cryogenic distillation, a plurality of distillation columns for separating the air into nitrogen and oxygen, a further distillation column having an inlet for an argon-enriched stream in fluid communication with an outlet from one of said plurality of distillation columns, and a condenser-reboiler adapted to provide reboil for the said further distillation column and reflux for another of said plurality of distillation columns.

8. Apparatus in accordance with claim 7, including an outlet from the bottom of said other distillation column in fluid communication with said distillation column from which the argon-enriched stream is withdrawn at a level intermediate that of the outlet through which the argon-enriched stream is withdrawn and the top of said column.

9. Apparatus in accordance with claim 7, wherein the inlet for the argon-enriched stream is in fluid communication with the outlet from said distillation column via said heat exchange means and an expansion turbine.

10. Apparatus for separating air, comprising at least one compressor for compressing air, means for removing carbon dioxide and water vapor from the air, heat exchange means for reducing the temperature of the air to a temperature suitable for its separation by cryogenic distillation, a distillation column for separating the air into nitrogen and oxygen, a further distillation column having an inlet for an argon-enriched stream in fluid communication with an outlet from said distillation column, and a condensor-reboiler adapted to provide reboil for said further distillation column and reflux for said distillation column.

11. Apparatus in accordance with claim 10, additionally including means for transferring argon-enriched liquid from said distillation column to said further distillation.

* * * * *